US005285644A

United States Patent [19]

Roehrich et al.

[11] Patent Number: 5,285,644

[45] Date of Patent: Feb. 15, 1994

[54] AIR CONDITIONING AND REFRIGERATION APPARATUS UTILIZING A CRYOGEN

[75] Inventors: Roland L. Roehrich, Pittsburgh, Pa.; Herman H. Viegas, Bloomington, Minn.

[73] Assignee: Thermo King Corporation, Minneapolis, Minn.

[21] Appl. No.: 982,364

[22] Filed: Nov. 27, 1992

[51] Int. Cl.[5] ..... F17C 9/04

[52] U.S. Cl. ..... 62/50.3; 62/167; 62/239

[58] Field of Search ..... 62/50.2, 50.3, 239, 62/167

[56] References Cited

U.S. PATENT DOCUMENTS

| | | | |
|---|---|---|---|
| 3,121,999 | 2/1964 | Kasbohm et al. | 62/50.3 |
| 3,385,073 | 5/1968 | Snelling | 62/52.1 |
| 3,802,212 | 4/1974 | Martin et al. . | |
| 4,045,972 | 9/1977 | Tyree, Jr. . | |
| 4,100,759 | 7/1978 | Tyree, Jr. . | |
| 4,186,562 | 2/1980 | Tyree, Jr. . | |
| 4,498,306 | 2/1985 | Tyree, Jr. . | |
| 5,040,374 | 8/1991 | Michaeu . | |
| 5,069,039 | 12/1991 | Martin . | |
| 5,090,209 | 2/1992 | Martin . | |

*Primary Examiner*—Ronald C. Capossela
*Attorney, Agent, or Firm*—M. J. Moran

[57] ABSTRACT

Methods and apparatus for controlling a conditioned space to a predetermined set point temperature, utilizing a supply of cryogen. Cryogen is drawn from the supply in a flow path to provide a cooling mode via a heat exchanger disposed in the flow path. A vapor motor in the flow path, downstream from the heat exchanger, drives a fan which moves air between the conditioned space and the heat exchanger. Heat is applied to the cryogen downstream from the heat exchanger, after all cooling modes have been performed, to provide the desired fan horsepower, without interfering with a cooling cycle. A by-pass flow path selectively directs cryogen directly to the vapor motor, by-passing the heat exchanger, to provide air circulation in the conditioned space when the temperature of the conditioned space is satisfied.

37 Claims, 3 Drawing Sheets

AIR CONDITIONING AND REFRIGERATION APPARATUS UTILIZING A CRYOGEN

TECHNICAL FIELD

The invention relates in general to air conditioning and refrigeration systems, and more specifically to the use of a cryogen for controlling the temperature of a conditioned space associated with stationary and transport applications of air conditioning and refrigeration systems.

BACKGROUND ART

Stationary and transport applications of air conditioning and refrigeration systems, with transport applications including those used on straight trucks, tractor-trailer combinations, refrigerated containers, and the like, conventionally utilize a chlorofluorocarbon (CFC) refrigerant in a mechanical refrigeration cycle. The mechanical refrigeration cycle requires a refrigerant compressor driven by a prime mover, which often includes an internal combustion engine, such as a diesel engine. Because of the suspected depleting effect of CFC's on stratospheric ozone ($O_3$), practical alternatives to the use of CFC's in air conditioning and refrigeration systems are being sought.

The use of a cryogen, i.e., a gas which has been compressed to a very cold liquid state, such as carbon dioxide ($CO_2$) and nitrogen ($N_2$), in air conditioning and refrigeration systems is particularly attractive because, in addition to eliminating the need for a CFC, it also eliminates the need for a compressor and associated prime mover.

Thus, it would be desirable, and it is an object of the present invention, to provide reliable, practical methods and apparatus which utilize a cryogen in air conditioning and refrigeration systems.

SUMMARY OF THE INVENTION

The invention includes methods and apparatus for conditioning the air of a conditioned space to a predetermined set point temperature, using a cryogen, such as liquid Nitrogen ($N_2$) or liquid carbon dioxide ($CO_2$).

The methods of the invention control the temperature of a conditioned space to a predetermined temperature band adjacent to a selected set point temperature via the steps of providing a supply of cryogen, providing a flow path for the cryogen, providing heat exchanger means in the flow path, providing cryogen driven air mover means in the flow path, moving air from the conditioned space in heat exchange relation with the heat exchanger means via the air mover means to provide a cooling cycle, and locating the air mover means in the flow path downstream from the heat exchanger means, such that the air mover means is located in the flow path after any and all cooling related operating modes have been completed.

The apparatus of the invention includes a refrigeration system for conditioning the air of a conditioned space to a predetermined temperature band adjacent to a selected set point temperature via a cooling mode, including a supply of cryogen, heat exchanger means, a flow path directing cryogen from the supply through the heat exchanger means, vapor driven motor means, and fan means driven by the vapor driven motor means which moves air from the conditioned space in heat exchange relation with the heat exchanger means. The air mover means is disposed in the flow path downstream from the heat exchanger means, such that the air mover means is located in the flow path after any and all cooling related operating modes have been completed.

In preferred embodiments of the invention, the methods and apparatus include heating the cryogen in the flow path, downstream from the heat exchanger means, to provide additional energy for operating the air mover means without deleteriously affecting a concomitant cooling cycle. In another aspect of the invention, the flow path is altered during a null period when the conditioned space is satisfied, to direct cryogen directly from the supply of cryogen to the air mover means, by-passing the heat exchanger means, to provide air circulation in the conditioned space during a null period. In still another aspect of the invention, liquid cryogen is drawn from the supply to provide a cooling cycle in the conditioned space, and the liquid flow path is simultaneously tapped and heated to provide an independent supply of heated cryogen for operating the air mover means, notwithstanding that the air of the conditioned space may be being cooled in a cooling cycle.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

As used in the following description and claims, the term "conditioned space" includes any space to be temperature and/or humidity controlled, including stationary and transport applications for the preservation of foods and other perishables, maintenance of a proper atmosphere for the shipment of industrial products, space conditioning for human comfort, and the like. The term "refrigeration system" is used to generically cover both air conditioning systems for human comfort, and refrigeration systems for preservation of perishables and shipment of industrial products. Also, when it is stated that the temperature of a conditioned space is controlled to a selected set point temperature, it is to be understood that the temperature of the conditioned space is controlled to a predetermined temperature range adjacent to the selected set point temperature. In the Figures, valves which are normally open (n.o.), are illustrated with an empty circle, and valves which are normally closed (n.c.) are illustrated with an "X" within a circle. Of course, the associated electrical or electronic control, hereinafter called "electrical control", may be changed to reverse the de-energized states shown. An arrow pointed at a valve in the Figures indicates that the valve is, or may be, controlled by the electrical control.

The invention is suitable for use when the refrigeration system is associated with a single conditioned space to be controlled to a selected set point temperature; and, the invention is also suitable for use when the refrigeration system is associated with a compartmentalized application in which a conditioned space is divided into at least first and second separate conditioned spaces to be individually controlled to selected set point temperatures. In a compartmentalized application, for example, one conditioned space may be used to condition a frozen load, and the other a fresh load, or combinations thereof, as desired.

Figure 1:
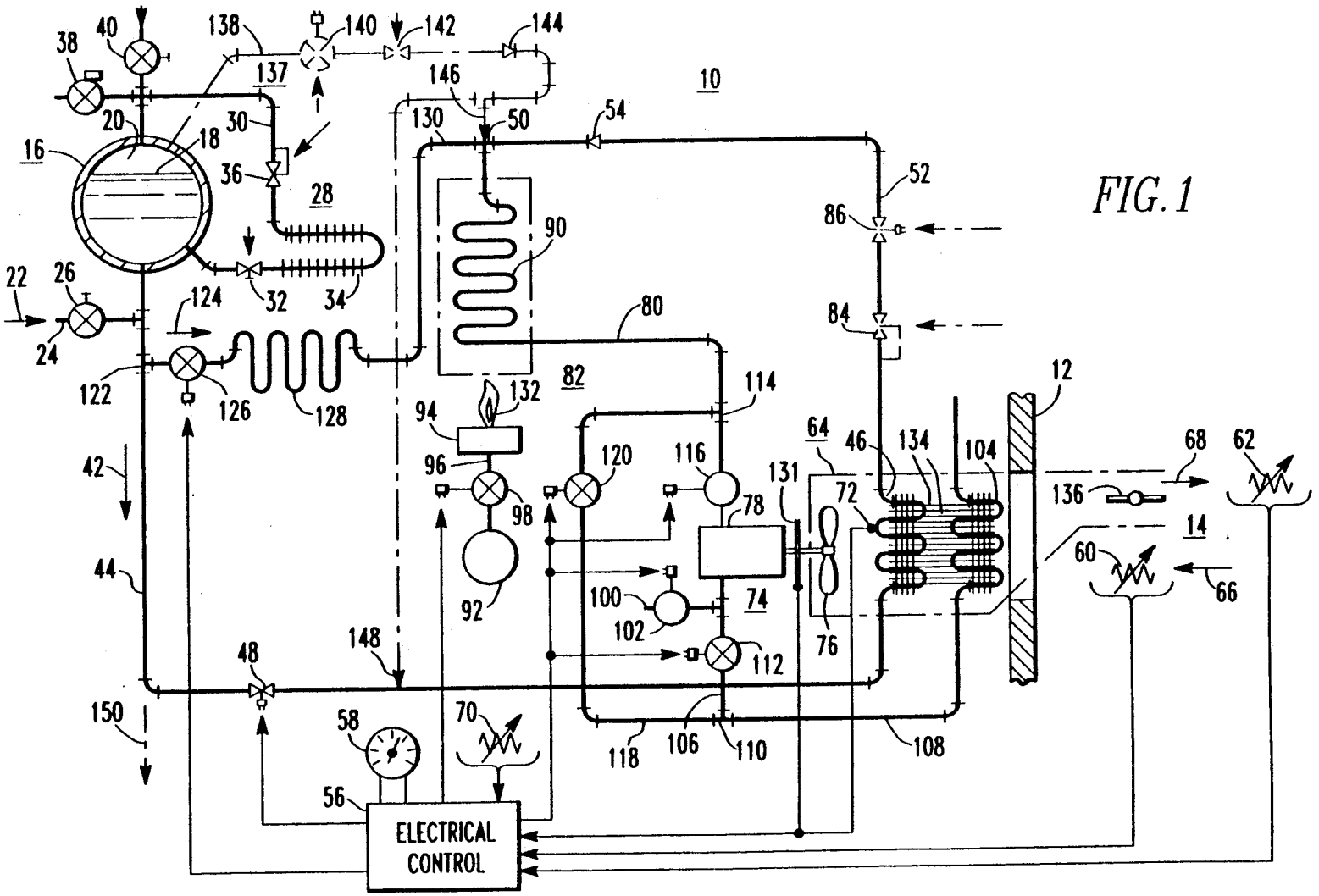
FIG. 1 is a diagrammatic representation of a refrigeration system constructed according to the teachings of the invention wherein liquid cryogen from a cryogen supply provides independent fan operating modes, enabling a fan or blower to operate at a desired fan horsepower, regardless of whether the associated conditioned space is in a heating cycle, a cooling cycle, or a null cycle.

Referring now to the drawings, and to FIG. 1 in particular, there is shown a refrigeration system 10 suitable for use with any conditioned space, stationary or transportable, with the invention particularly well suited for use in transport applications which include vehicles such as straight trucks, tractor-trailer combinations, containers, and the like, with the word "vehicle" being used to generically refer to the various transport vehicles which utilize refrigeration systems.

Refrigeration system 10 may be associated with stationary and transport applications, with reference number 12 generally indicating a vehicle in a transport application, and an enclosure wall in a stationary application. Refrigeration system 10 may be associated with a single conditioned space 14 to be controlled to a predetermined set point temperature, and refrigeration system 10 may be associated with a compartmentalized application in which conditioned space 14 is divided into two or more separate conditioned spaces to be individually conditioned to selected set point temperatures. For purposes of example only, the embodiments of the invention set forth in the Figures illustrate a single conditioned space 14.

More specifically, refrigeration system 10 includes a vessel 16 containing a suitable cryogen, such as nitrogen ($N_2$), or carbon dioxide ($CO_2$), for example, with a liquid phase thereof being indicated at 18. Vessel 16 also contains cryogen in vapor form, above the liquid level, with the vapor form being indicated at 20. Vessel 16 may be filled, for example, by connecting a ground support apparatus or truck, generally indicated at 22, to a supply line or conduit 24 which includes a valve 26. Vapor pressure in vessel 18 is maintained above a predetermined minimum value selected for optimum system performance. When the cryogen is $CO_2$ the predetermined minimum value is selected to be above the triple point or slush point of $CO_2$, i.e., 75.13 psia, by a known prior art pressure regulating arrangement 28 in which a conduit 30 connects a lower point of vessel 16 with an upper point thereof. Conduit 30 includes a valve 32, a vaporizing coil 34, and a valve 36. Valve 32 opens when the pressure in vessel 16 falls to the predetermined value, admitting liquid cryogen 18 into vaporizing coil 34. Vaporizing coil 34 is exposed to ambient temperature outside of vehicle 12. A pressure reading safety valve 38 is also provided in conduit 30 at a point where the vapor pressure in vessel 16 may be directly sensed. A venting valve 40 is also provided to facilitate the filling process. Again, using $CO_2$ as an example for the cryogen, vessel 16 may be filled with $CO_2$ at an initial pressure of about 100 psia and an initial temperature of about −58° F. (−50° C.). Of course, other pressures and temperatures may be used than set forth in this example, such as an initial pressure of about 300 psia and an initial temperature of about 0° F. (−17.8° C.). The initial temperature is selected to be thermodynamically compatible with the lowest selectable operating temperature of the conditioned space 14.

Figure 2:
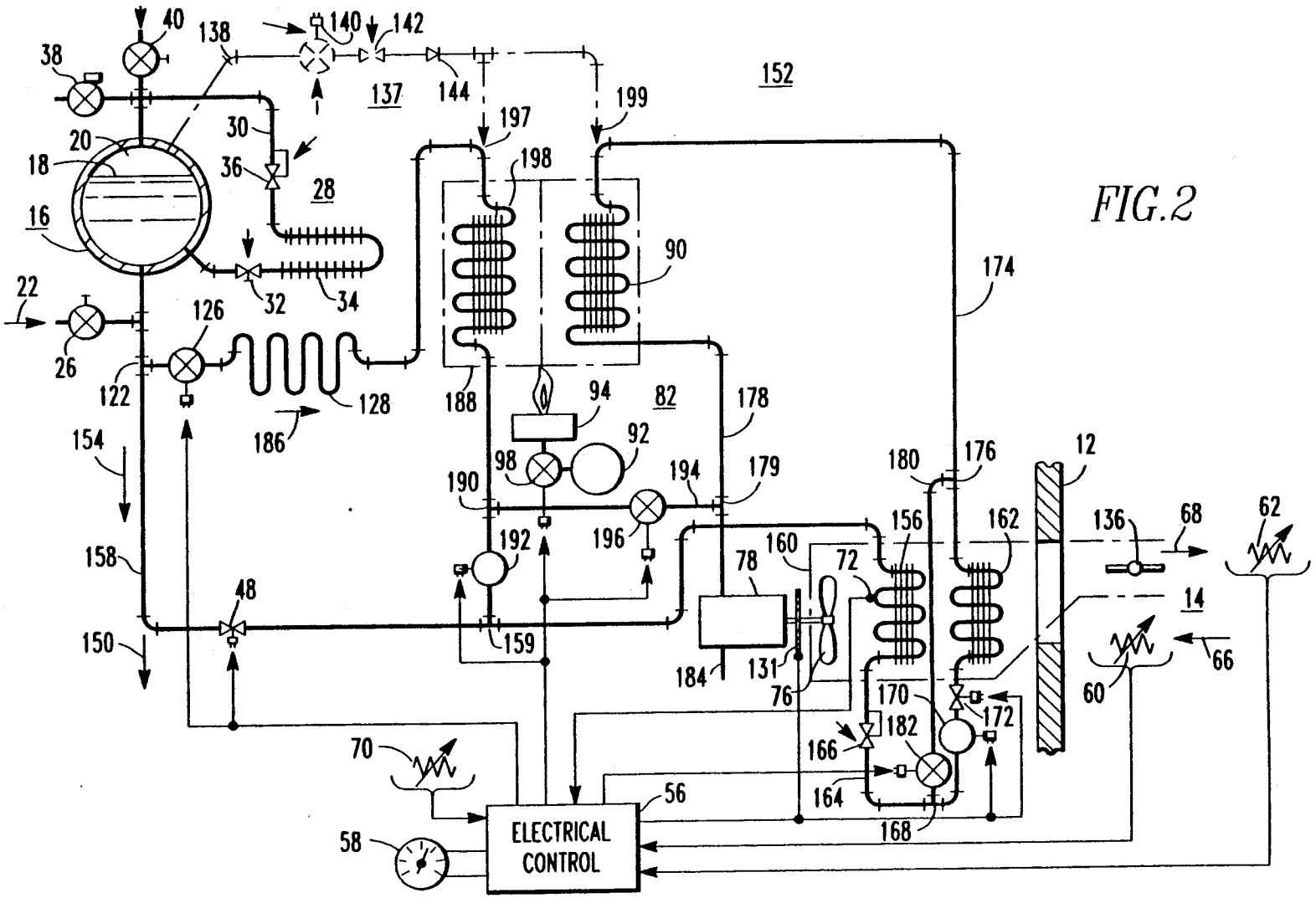
FIG. 2 is a diagrammatic representation of a refrigeration system constructed according to another embodiment of the invention which utilizes liquid to provide independent fan control operating modes.

The present invention relates primarily to new and improved arrangements for providing air mover methods and apparatus for refrigeration system 10, by utilizing liquid cryogen 18 from supply vessel 16, and also by utilizing vaporized cryogen 20 from supply vessel 16. FIGS. 1 and 2 relate to the use of liquid cryogen 18 for implementing such air moving methods and apparatus, and FIG. 3 relates to the use of vaporized cryogen 20 for implementing such air moving methods and apparatus.

A first cryogen flow path 42 is provided which draws liquid cryogen 18 from vessel 16 via a conduit 44. Conduit 44 extends from a low point of vessel 16 to a first heat exchanger 46 via a flow regulating valve 48. The first flow path 42 continues from the first heat exchanger 46 to a tee 50 via a conduit 52 which may include a check valve 54.

Flow regulating feed valve 48 is controlled by electrical control 56 as a function of system conditions at any instant. For example, valve 48 may be controlled as a function of the set point temperature, the actual temperature of conditioned space 14, and the ambient temperature. The set point temperature for conditioned space 14 is selected by a set point temperature selector 58. The temperature of conditioned space 14 is sensed by either, or both, return air and discharge air temperature sensors 60 and 62. Temperature sensor 60 senses the temperature of air returning to an air conditioning means or apparatus 64, with the return air being indicated by arrow 66. The hereinbefore mentioned first heat exchanger 46 is associated with air conditioning apparatus 64. Temperature sensor 62 senses the temperature of air being discharged by air conditioning apparatus 64, with the discharge air being indicated by arrow 68. The temperature of ambient air is sensed by an ambient air temperature sensor 70. The conditioned air 68, which results from the heat exchange relation between the return air 66 and heat exchanger 46, is discharged back into conditioned space 14. Conditioned air does not mix with cryogen at any point in the refrigeration systems of the invention. Thus, there is never any contamination of conditioned space 14 with cryogen. Refrigeration system 10, however, may be used in combination with arrangements which inject $CO_2$ into a conditioned space for fast temperature pull down and/or for load preservation. In such combined applications vessel 16 may be used as the source of the $CO_2$.

A temperature sensor 72 is disposed to sense the surface temperature of the first heat exchanger 46 at a location at or near the exit end of heat exchanger 46 to detect when evaporation may not be 100%, such as when surface ice builds up on heat exchanger 46. Thus, temperature sensor 72 may be used to trigger a defrost mode or cycle, as will be hereinafter explained. When other means is used to trigger defrost, such as a timer, temperature sensor 72 may be used to cut the flow rate of flow regulating valve 48 when the temperature drops to a predetermined value which indicates that evaporation may not be complete. Temperature sensor 72 may also be used to detect the degree of superheat in the vaporized cryogen, as well as detecting when evaporation may not be 100%, such as when surface ice builds up on heat exchanger 46. Thus, temperature sensor 72 may be used to enable electrical control 56 to control the flow rate of cryogen through valve 48 to maintain a desired degree of superheat in the vaporized cryogen exiting heat exchanger 46.

Air in conditioned space 14 is drawn into air conditioning apparatus 64, and discharged back into conditioned space 14, by air mover means 74. Air mover means 74 includes a fan or blower 76 which is driven by vaporized cryogen in a suitable vapor driven motor or turbine 78, which will hereinafter be referred to as vapor driven motor 78.

The first heat exchanger 46 is configured and dimensioned, and the cryogen flow rate controlled, to completely vaporize the liquid cryogen 18, and thus vaporized cryogen is delivered from the exit end of heat exchanger 46 to tee 50. The first flow path 42 continues from tee 50 to the input of vapor driven motor 78 via a conduit 80 which includes cryogen heating means 82. Depending upon the pressure of the cryogen in vessel 18, conduit 52 may also include a back pressure regulating valve 84 and an expansion valve 86, both shown in phantom. Expansion valve 86 isenthalpically expands the vaporized cryogen before being directed to the vapor operated motor 78. Valves 86 and 88 may have manually adjustable or fixed orifices, or the orifice sizes may be controlled by electrical control 56.

Cryogen heating means 82 includes a heat exchanger coil 90 connected in the cryogen flow path which includes conduit 80, and a fuel supply 92 connected to a suitable burner 94 via a conduit 96 which includes a valve 98. The fuel from fuel supply 92, for example, may include liquefied natural gas, propane, diesel fuel, and the like. In stationary applications, other available source of heat may be used, including electrical, hot liquids, and hot waste gases.

The output of vapor driven motor 78 is selectively connectable to a vent conduit 100 via a valve 102, and to a second heat exchanger 104 via conduits 106 and 108 interconnected via a tee 110. Conduit 106 includes a valve 112. In a stationary application, the $CO_2$ may be collected and compressed into a cryogenic state for reuse.

The first flow path 42 is selectively alterable to bypass the air mover means 74 via a tee 114 disposed in conduit 80, with a valve 116 being disposed between tee 114 and the input of vapor motor 78. Tee 114 extends to tee 110 via a conduit 118 which includes a valve 120. Valves 116 and 120 may select one or the other of the parallel flow paths between tees 114 and 110, or both, as required by current operating conditions. Valves 116 and 120 may be proportional valves, instead of on/off valves, which selectively enable vaporized cryogen to flow through either, or both, of the parallel flow paths between tees 114 and 110, at selected flow rates.

The liquid portion of the first flow path 42 is tapped between flow regulating valve 48 and vessel 16, via a tee 122. A second cryogen flow path 124 interconnects tee 122 with the hereinbefore mentioned tee 50 disposed in the first flow path 42. The second cryogen flow path 124 includes a valve 126, an ambient loop 128, and a conduit 130. Ambient loop 128 is located to expose liquid cryogen 18 to ambient temperature, vaporizing the liquid cryogen. As disclosed in concurrently filed application Ser. No. 07/982,333 the effectiveness of any ambient loops, such as ambient loops 34 and 128, may be enhanced by directing heat produced by the operation of the associated refrigeration system, e.g., heat produced by burner 94 and heat expended cryogen, when the temperature of the expended cryogen exceeds ambient temperature, into contact with the ambient loops.

Thus, the second cryogen flow path 124 joins the first cryogen flow path 42 at tee 50. The flow path between tee 50 and vapor motor 78 is controllable to make it a sole portion of the first flow path 124, a sole portion of the second flow path 124, or a combined flow path which includes flow from both the first and second flow paths 42 and 124, as required by conditioned space 14 at any instant.

A cooling cycle which removes heat from the return air 66 to reduce the temperature of conditioned space 14 is initiated by opening flow regulating valve 48, and vaporizing liquid cryogen 18 in the first heat exchanger 46. During a cooling cycle valves 100 and 116 would be open, and valve 126 would be closed.

The first heat exchanger 46 is the last cooling related heat exchange apparatus in the first or the second flow paths, singly or combined, and thus the vaporized cryogen may be heated downstream therefrom, if necessary, in cryogen heating means 82 to achieve the desired fan horsepower. When heat is required, control 56 opens valve 98 and ignites the fuel from fuel supply 92 to provide a flame 132 which adds heat to the cryogen flowing through heat exchanger 90. When the temperature of conditioned space 14 is near the selected set point temperature, there will be little flow of cryogen through the first heat exchanger 46, and when the fan horsepower drops to a predetermined low marginal value, control 56 opens valve 126 to tap the liquid cryogen flow path 124, and provide the required total flow of heated cryogen through vapor driven motor 78. Air flow rate may be detected, for example, by speed sensor means 131 associated with vapor motor 78, such as by utilizing a toothed wheel and sensor.

Thus, completely independent control may be provided over the horsepower, speed, and air flow rate of fan 76 via the cryogen heating apparatus 82, without deleteriously affecting a cooling cycle which may be taking place simultaneously with the heating of the cryogen. The heated cryogen leaving vapor motor 78 is not passed through any heat exchanger associated with air conditioning apparatus 64 during a cooling cycle. As hereinbefore stated, the first heat exchanger 46 is the last heat exchange apparatus in the cryogen flow path which is associated with a cooling mode for conditioned space 14. Air mover means 74, located downstream from the first heat exchanger means 46, may thus have the cryogen heated to any suitable temperature, as required to derive the required fan horsepower at any instant.

During a heating cycle to hold the temperature of the conditioned space 14 in a predetermined temperature band adjacent to the selected set point temperature, flow control valve 48 and valve 102 will be closed, and valves 126, 116, 112 and 98 will be open. Thus, liquid cryogen from the second flow path 124 will be heated, passed through vapor motor 78 and then passed through the second heat exchanger 104 to add heat to the return air 66 before discharging the heated air 68 back into the conditioned space 14. Appropriate control of the supply valve 126, as well as control of valves 116 and 120 which control the flow through the parallel flow paths between tees 114 and 110, select the desired proportions of heated cryogen circulated through vapor motor 78, the second heat exchanger 104, and the flow rate from tee 110 to the second heat exchanger 104, to obtain the desired air flow rate and the desired heating of the conditioned space 14. For example, valve 126 may be operated on-off to provide a predetermined percent of "on" to "off" flow time, or valve 126 may be proportional valve; and/or valve 120 may be operated on-off to allow a portion of the heated cryogen to by-pass vapor driven motor 78 when the air flow rate is too great; and/or valve 100 may be operated on-off to reduce the amount of heated cryogen reaching the second heat exchanger 104 as the conditioned space temperature approaches set point, without reducing fan horsepower. As hereinbefore stated, valves 116 and 120 may also be proportional valves, controlling the size of a flow orifice, instead of operating in an on-off mode.

A defrost mode, required to defrost the first heat exchanger 46, is similar to a heating mode to hold set point, except valve 116 would be closed and valve 120 would be open, to stop vapor motor 78 during a defrost cycle. The heated cryogen is passed through the second heat exchanger 104 via the by-pass flow path which includes the open valve 120. The second heat exchanger 104 is disposed in heat exchange relation with the first heat exchanger 46, as illustrated by the heat conductive fins 134 disposed between the two heat exchangers 46 and 104, quickly melting water ice which builds up on the first heat exchanger 46 during a cooling cycle. Instead of stopping vapor motor 78 during a defrost cycle, a controllable defrost damper 136 may be provided. When provided, damper 136 would be closed during a defrost cycle, preventing warm air from being discharged into conditioned space 14. When defrost damper 136 is closed, vapor operated motor 78 may be allowed to continue to operate, i.e., valve 116 may be open and valve 120 closed, which arrangement reduces defrost time due to the circulation of air about heat exchangers 46 and 104 provided by fan 76.

When the temperature of conditioned space 14 is satisfied, requiring neither a cooling cycle nor a heating cycle to hold the temperature of conditioned space 14 in a predetermined narrow temperature band adjacent to the selected set point temperature, a null cycle may be provided. Such a null cycle is provided, with independent control over air flow in conditioned space 14, without passing cryogen through either of the heat exchangers 46 and 104. Air flow control during a null cycle is provided by closing valve 48, and opening valves 126 and 98. Valves 116 and 102 remain open, and valves 112 and 120 remain closed. Thus, liquid cryogen from the second flow path 124 is heated in cryogen heating means 82, passed through vapor driven motor 116, and discharged through valve 102 and vent conduit 100.

During the operation of refrigeration system 10 in a cooling cycle, it is necessary to maintain the pressure of the cryogen above a predetermined value, which, when the cryogen is $CO_2$, is above the triple point thereof. Back pressure regulators may be located at strategic locations in the flow paths, such as back pressure regulator 84; or, the vapor pressure in vessel 16 may be used to maintain the pressure in the flow paths above the desired minimum value. An arrangement 137 for using vapor pressure in vessel 18 for providing such pressure regulation is shown in phantom, including a conduit 138, a valve 140, which may be manually operable, or controlled by electrical control 56, and a fixed or controlled pressure regulating valve 142. A check valve 144 is illustrated, but may be unnecessary as the vapor pressure in vessel 18 should always be higher than the pressure at any flow path point. Conduit 138 may have a smaller opening diameter than the opening diameters of the main flow conduits. As indicated, the first flow path 44 may be tapped and connected to the pressure maintaining flow path where necessary, such as indicated by arrows 146 and 148.

Arrow 150 indicates that the first liquid flow path 42 may be further tapped to provide liquid cryogen for heat exchange apparatus associated with additional heat exchangers, such as for conditioning an additional conditioned space, or spaces, when refrigeration system 10 is associated with a compartmentalized application.

FIG. 2 is a diagrammatic representation of a refrigeration system 152 constructed according to another embodiment of the invention which utilizes liquid cryogen to implement fan control apparatus. As in the embodiment of FIG. 1, the fan operating modes in the embodiment of FIG. 2 are not restricted or impaired by the type of refrigeration cycle, cooling, heating or null, the associated refrigeration system 152 is currently operating in, nor by the amount of cryogen flowing through a heat exchanger. Components in FIG. 2 which are the same as those in FIG. 1 are given like reference numbers, and descriptions thereof are not repeated.

A first cryogen flow path 154 is connected from a low point on supply vessel 16 to a first heat exchanger 156, via a conduit 158 which includes the liquid cryogen tapping tee 122, the flow regulating valve 48, and a tee 159 located between valve 48 and the first heat exchanger 156. The first heat exchanger 156, which is associated with an air conditioning means or apparatus 160, is connected to a second heat exchanger 162 via a conduit 164 which includes a pressure regulating valve 166, a tee 168, a valve 170, and an isenthalpic expansion valve 172.

The output of the second heat exchanger 162 is connected to the input of vapor driven motor 78 via a conduit 174 which includes a tee 176, the hereinbefore mentioned cryogen heating means 82, and a conduit 178 which includes a tee 179. A conduit 180 containing a valve 182 interconnects tees 168 and 176, enabling the second heat exchanger 162 to be by-passed when desired, such as during staged heating or cooling as the temperature of conditioned space 14 nears the set point temperature. "Staged" heating and cooling refers to operation of only one of the heat exchangers 156 or 162 in temperature ranges immediately adjacent to both sides of the selected set point temperature, and operation of both heat exchangers 156 and 162 outside these temperature ranges. The output of vapor motor 78 may be connected to a vent conduit 184. As hereinbefore stated, in stationary applications, cryogen may be collected and compressed for re-use, instead of exhausting expended cryogen to the atmosphere.

A second cryogen flow path 186 interconnects tees 122 and 159 in the first cryogen flow path 154 via the valve 126, the ambient loop 128, cryogen heating means 188, a tee 190, and a valve 192. A conduit 194 interconnects tees 190 and 179 via a valve 196. The cryogen heating means 188 includes a heat exchanger coil 198, which, as indicated, may be part of heat exchanger means 82, being heated by burner 94; or, a separate burner and controllable valve may be connected to fuel supply 92, as desired.

A cooling cycle is initiated in refrigeration system 152 by opening flow regulating valve 48, while valve 126 remains closed, and the first cryogen flow path 154 directs liquid cryogen to the first heat exchanger 156 where it is vaporized, removing heat from the return air 66. During initial temperature pull-down of conditioned space 14, valve 170 would be open and valve 182 would be closed, as illustrated, and the vaporized cryogen is isenthalpically expanded in expansion valve 172, prior to directing the vaporized cryogen through the second heat exchanger 162. In this embodiment, the second heat exchanger 162 is the last heat exchanger in the cryogen flow path which is associated with a cooling mode or cycle, and thus the vaporized cryogen may be heated in cryogen heating means 82 without deleterious affect on the on-going cooling cycle.

As the temperature of conditioned space 14 is approached, the by-pass flow path which includes conduit 180 may be activated. This allows cryogen at a higher pressure to enter heat exchanger 90. The higher the pressure of the cryogen entering heat exchanger 90, the lower the temperature the cryogen need be heated to, for equivalent fan horsepowers, thus conserving fuel in supply 92.

A heating cycle initiated to achieve the selected set point temperature is initiated by closing valve 48 and opening valves 126 and 98. The liquid cryogen in the second flow path 186 is thus initially heated in ambient loop 128, and selectively heated to a higher temperature in heat exchanger 198, before it is passed through heat exchanger 156, and optionally through heat exchanger 162, to add heat to the return air 66 from conditioned space 14. The heated cryogen reaching heat exchanger 90 is heated to a still higher temperature, when there is a single burner 94; and, the heated cryogen reaching heat exchanger 90 may be optionally heated, when there are two burners, as required to provide the desired horsepower for driving vapor motor 78.

During a defrost heating mode to defrost water ice which collects on the external surfaces of the first and second heat exchangers 156 and 162, the second flow path 186 is activated to heat the liquid cryogen in ambient loop 128 and in heat exchanger 198, and the heated cryogen is passed through both heat exchangers 156 and 162. When two burners are provided, it is not necessary to heat the cryogen in heat exchanger 90 during defrost, as the RPM of vapor motor 78 is not critical. The controlled damper 136 is closed during defrost to prevent any air moved by fan 76 from entering conditioned space 14. Instead of damper 136, a dump valve (not shown) may be disposed in conduit 178, to dump the heated cryogen to the atmosphere before reaching vapor motor 78 during a defrost operation.

When the temperature of conditioned space is in a predetermined narrow temperature band adjacent to the selected set point temperature which requires neither a cooling cycle nor a heating cycle, air circulation in conditioned space 14 is provided, without directing cryogen through either heat exchanger 156 or 162, by closing valves 48 and 192 and by opening valves 126, 196 and 98. Thus, liquid cryogen is heated in the second flow path 186 and directed to vapor driven motor 78. Conduit 194 and the open valve 196 form a by-pass flow path which causes the heated cryogen to by-pass heat exchangers 156 and 162.

As described relative to FIG. 1, vapor pressure in vessel 16 may be used instead of back pressure regulating valves, to maintain the pressure in the flow paths above the desired minimum value, as indicated by arrows 197 and 199 in FIG. 2.

Figure 3:
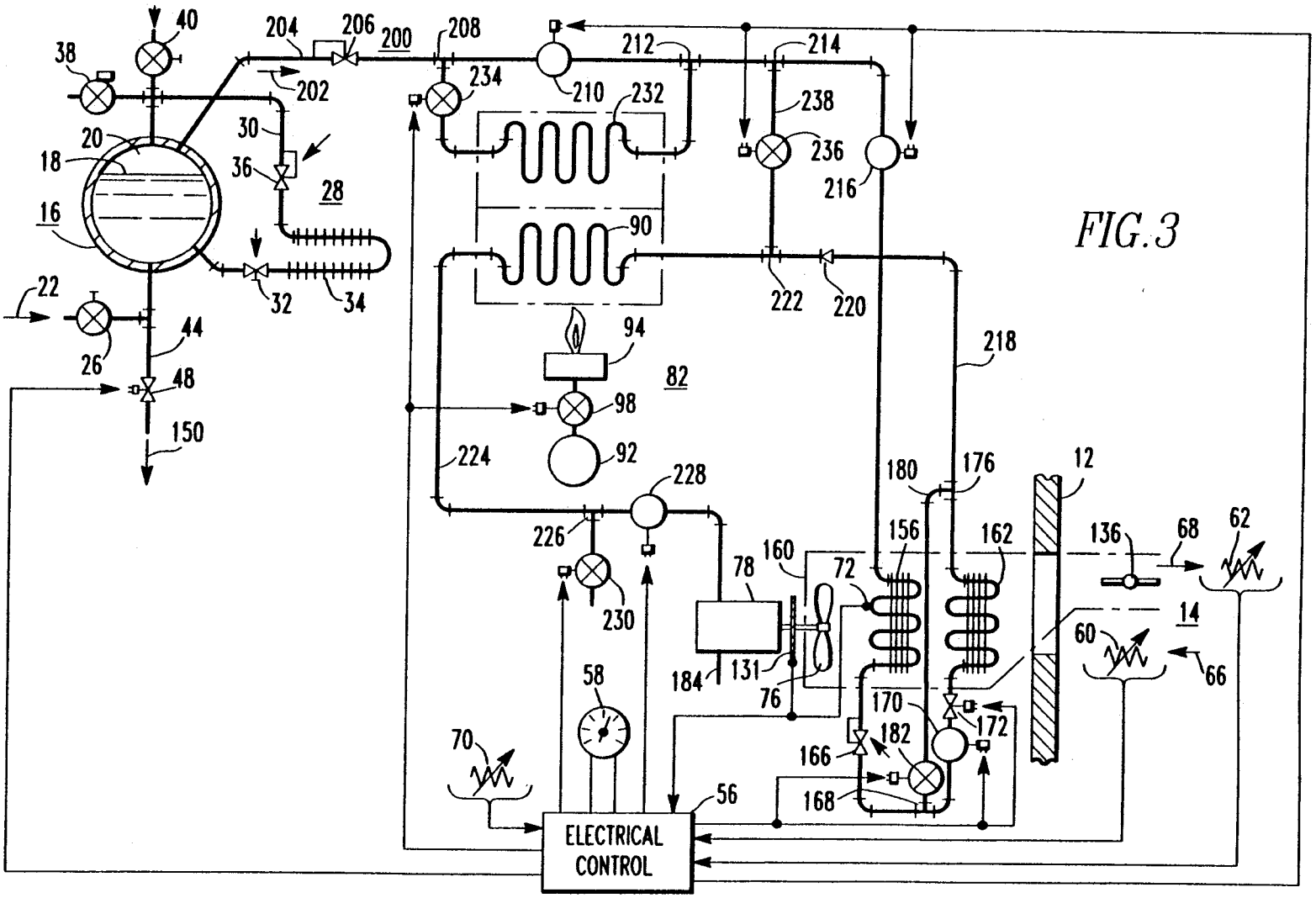
FIG. 3 is a diagrammatic representation of a refrigeration system illustrating an embodiment of the invention in which independent fan control operating modes are provided by utilizing vaporized cryogen drawn from the supply of cryogen.

FIG. 3 is a diagrammatic representation of a refrigeration system 200 which provides independent fan control operating modes, similar to those described relative to the embodiments of the invention set forth in FIGS. 1 and 2, except the FIG. 3 embodiment utilizes vaporized cryogen 20 from supply vessel 16, instead of liquid cryogen 18. An adequate supply of vapor in vessel 16 is provided by the hereinbefore described pressure building flow path 28. Components in the embodiment of FIG. 3 which may be the same as in the embodiments of FIGS. 2 and 3 are identified with like reference numbers, and their descriptions are not repeated. For purposes of example, the heat exchanger arrangement of FIG. 2 is used in the FIG. 3 embodiment.

More specifically, refrigeration system 200 of FIG. 3 includes a vaporized cryogen flow path 202 which interconnects an upper point of vessel 16 with the input of the first heat exchanger 156, via a conduit 204. In the embodiment of FIG. 2, the first heat exchanger 156 functions as an evaporator, evaporating the liquid cryogen 18. In the embodiment of FIG. 3, heat exchanger 156 functions as a vapor to air heat exchanger, receiving vaporized cryogen 20 from vessel 16.

Conduit 204 includes a pressure regulating valve 206, a tee 208, a valve 210, tees 212 and 214, and a valve 216. The exit end of the second heat exchanger 162 is connected to heat exchanger 90 of cryogen heating means 82 via a conduit 218, a check valve 220, and a tee 222. The output of heat exchanger 90 is connected to the input of vapor motor 78 via a conduit 224, a tee 226, and a valve 228. Tee 226 is connected to a dump valve 230.

A heat exchanger 232 is connected between tees 208 and 212 via a valve 234. Heat exchanger 232 selectively adds heat to the vaporized cryogen 20, such as for heating and defrost cycles in air conditioning apparatus 160. Heat exchanger 232 may be part of heating means 82, being heated by burner 94, or a separate burner and controllable valve may be connected to fuel supply 92, as desired. A valve 236 is disposed in a conduit 238, with conduit 238 interconnecting tees 214 and 222.

In a cooling cycle, vaporized cryogen 20 passes through the normally open valves 210, 216, 170, and 228, to remove heat from conditioned space 14 via the first and second heat exchangers 156 and 162. As set point is approached, valve 170 may be closed, and valve 182 opened, to reduce the cooling rate and providing cryogen at a higher pressure to vapor motor 78. Burner 94 is ignited, as required, to add heat and fan horsepower for the desired operation of vapor motor 78. As in the other embodiments, vapor motor 78 is located after all cooling related modes or cycles associated with air conditioning apparatus 160 have been performed, and therefore the cryogen may be heated downstream therefrom to any desired temperature without adverse affect on the simultaneous cooling cycle taking place in air conditioning apparatus 160.

In a heating cycle required to raise the temperature of conditioned space 14, to achieve a predetermined temperature band adjacent to the selected set point temperature, valve 210 is closed and valves 234 and 98 are opened, to divert vaporized cryogen 20 through heat exchanger 232, which is heated by burner 94. As set point is approached, valve 170 may be closed and valve 182 opened to reduce the heating rate and provide cryogen at a higher temperature and pressure for vapor motor 78. Additional heat will be added to the cryogen during a heating cycle via heat exchanger 90, if heat exchangers 232 and 90 are both associated with burner 94. If separate burners are used, the burner associated with heat exchanger 90 may be activated only when additional heat is necessary to achieve the desired fan horsepower.

A defrost cycle is similar to the heating cycle just described, except both heat exchangers 156 and 162 remain in the active cryogen flow path. If valves 228 and 230 are not included, damper 136 is closed during a defrost cycle. With valves 228 and 230 present, defrost damper 136 is not essential, as vapor motor 78 may be stopped during a defrost cycle by closing valve 228 and opening dump valve 230.

When the temperature of the served conditioned space 14 is in a "satisfied" temperature band adjacent to the selected set point temperature, air circulation in conditioned space 14 is provided without circulating cold or heated cryogen through heat exchangers 156 and 162, by closing valve 216 and opening valves 236 and 98, to heat the vaporized cryogen 20 to the temperature necessary to achieve the desired fan horsepower output from vapor motor 78. Since the vapor pressure will be high, a given amount of cryogen will deliver a given fan horsepower via vapor motor 78 at a lower temperature. Thus, it is not essential that valve 210 be closed and that valve 234 be opened to add additional heat to the cryogen. However, if heat exchangers 90 and 232 are heated by a single burner 94, both heat exchangers 90 and 232 may be used to maximize the temperature of the cryogen for the amount of fuel being used from fuel supply 92. The resulting higher temperature enables electrical control 56 to reduce the amount of cryogen required from vessel 16 during this independent fan operating mode, by adding a flow rate control valve to conduit 204 between back pressure regulator 206 and tee 208.

While not illustrated in the Figures, in order to prevent excessive pressures from building up when the refrigeration systems of the invention are shut down, a pressure relief valve should be added at any location where cryogen may be trapped between two valves at shut down.

Also, while not illustrated, it is to be understood that in transport applications blowers and/or fans driven by electrical motors powered by the vehicle electrical system, other suitable source, may augment the vapor motors, for moving air between the conditioned spaces and the associated heat exchangers. This is also applicable to stationary applications, with the electrical mains being used to power electrical motors connected to fans and/or blowers. Also, in transport applications, the vapor motors may drive electrical generators or alternators for the purpose of charging batteries associated with the refrigeration system control.

We claim:

1. A method for controlling the temperature of a conditioned space, comprising the steps of:

providing a supply of cryogen, providing a flow path for the cryogen, wherein cryogen from the supply of cryogen flows through the cryogen flow path, using the cryogen in the cryogen flow path to provide a cooling cycle for the conditioned space, including the step of providing heat exchanger means in the cryogen flow path, using the cryogen in the cryogen flow path to move air from the conditioned space in heat exchange relation with the heat exchanger means, after the step of using the cryogen to provide the cooling cycle for the conditioned space, including the step of providing cryogen driven air mover means in the cryogen flow path downstream from the heat exchanger means, such that the cryogen driven air mover means utilizes cryogen which is not required for the cooling cycle, and controlling the flow of cryogen through the cryogen flow path to control the temperature of the conditioned space.

2. The method of claim 1 wherein the step of providing the supply of cryogen includes providing cryogen in a liquid state, and the step of providing the cryogen flow path directs liquid cryogen from the supply of cryogen into the cryogen flow path, and including the step of vaporizing the liquid cryogen in the heat exchanger means, to provide vaporized cryogen for the cryogen driven air mover means.

3. The method of claim 1 wherein the step of providing the supply of cryogen includes providing cryogen in a vapor state, and the step of providing the cryogen flow path directs cryogen in the vapor state from the supply of cryogen into the cryogen flow path.

4. The method of claim 1 including the step of altering the cryogen flow path to by-pass the heat exchanger means, to selectively direct cryogen in the cryogen flow path directly to the cryogen driven air mover means without going through the heat exchanger means.

5. The method of claim 4 including the step of heating the cryogen in the cryogen flow path, upstream from the cryogen driven air mover means.

6. The method of claim 1 including the step of heating the cryogen in the cryogen flow path, downstream from the heat exchanger means and upstream from the cryogen driven air mover means.

7. The method of claim 1 including the step of regulating the vapor pressure of vaporized liquid cryogen in the cryogen flow path to a point above the triple point of the cryogen, to prevent the formation of solid cryogen in the cryogen flow path.

8. The method of claim 7 wherein the supply of cryogen is at a predetermined pressure above the triple point of the cryogen, with the regulating step including the step of introducing the pressure of the cryogen supply at a predetermined location in the cryogen flow path, to maintain the pressure at the predetermined location of the cryogen flow path above the triple point of the cryogen.

9. The method of claim 1 including the steps of:

providing a second cryogen flow path from the supply of cryogen directly to the cryogen driven air mover means, and directing cryogen from the supply of cryogen through both cryogen flow paths simultaneously.

10. The method of claim 9 including the steps of combining the two cryogen flow paths upstream from the cryogen driven air mover means, and heating cryogen in the combined cryogen flow path upstream from the cryogen driven air mover means.

11. The method of claim 9 wherein the supply of cryogen includes liquid cryogen, and the two cryogen flow paths receive liquid cryogen from the supply of cryogen, and including the step of adding heat to the liquid cryogen in the second cryogen flow path to vaporize the liquid cryogen.

12. The method of claim 1 including the step of using the cryogen in the cryogen flow path to provide a heating cycle for the conditioned space, after the step of using the cryogen in the cryogen flow path to move air in heat exchange relation with the heat exchanger means, with the step of using the cryogen in the cryogen flow path to provide a heating cycle including the steps of:

altering the cryogen flow path to by-pass the heat exchanger means, to selectively direct cryogen directly to the cryogen driven air mover means without going through the heat exchanger means, heating the cryogen in the cryogen flow path, upstream from the cryogen driven air mover means, providing additional heat exchanger means in the cryogen flow path, downstream from the cryogen driven air mover means, for use in the heating cycle for the conditioned space, with the step of moving air from the conditioned space in heat exchange relation with the heat exchanger means also moving air from the conditioned space in heat exchange relation with the additional heat exchanger means, and directing heated cryogen through the cryogen driven air mover means and the additional heat exchanger means.

13. The method of claim 12 including the step of additionally altering the cryogen flow path to provide a parallel cryogen flow path around the cryogen driven air mover means, and directing heated cryogen to the additional heat exchanger means through both the cryogen driven air mover means and the parallel cryogen flow path.

14. The method of claim 1 including the step of providing a defrost cycle, with the step of providing a defrost cycle including the steps of:

altering the cryogen flow path to by-pass the heat exchanger means, to selectively direct cryogen in the altered cryogen flow path directly to the cryogen driven air mover means without going through the heat exchanger means, heating the cryogen in the cryogen flow path upstream from the cryogen driven air mover means, providing an additional heat exchanger in the cryogen flow path, downstream from the cryogen driven air mover means, for use in a defrost cycle, with the additional heat exchanger being in heat exchange relation with the heat exchanger means, positioning the additional heat exchanger in the cryogen flow path, downstream from the cryogen driven air mover means, additionally altering the cryogen flow path to provide a by-pass cryogen flow path around the cryogen driven air mover means, and directing heated cryogen to the additional heat exchanger through only the by-pass cryogen flow path.

15. The method of claim 1 wherein the heat exchanger means includes first and second serially connected heat exchangers in the cryogen flow path, and including the step of expanding cryogen isenthalpically in the cryogen flow path between the first and second serially connected heat exchangers.

16. The method of claim 1 including the step of using the cryogen in the cryogen flow path to provide a heating cycle, including the step of heating the cryogen in the cryogen flow path upstream from the heat exchanger means.

17. The method of claim 1 including the step of using the cryogen in the cryogen flow path to provide a heating cycle, including the steps of heating the cryogen in the cryogen flow path, upstream from the heat exchanger means, and heating the cryogen in the cryogen flow path downstream from the heat exchanger means and upstream from the cryogen driven air mover means.

18. The method of claim 1 including the step of using cryogen in the cryogen flow path to provide a defrost cycle, including the steps of heating the cryogen in the cryogen flow path, upstream from the heat exchanger means, and exhausting the heated cryogen from the cryogen flow path, downstream from the heat exchanger means and upstream from the cryogen driven air mover means.

19. A refrigeration system for controlling the temperature of a conditioned space, including a supply of cryogen, heat exchanger means, a cryogen flow path which directs cryogen from the supply of cryogen through the heat exchanger means, and cryogen driven air mover means in the cryogen flow path which moves air from the conditioned space in heat exchange relation with the heat exchanger means to provide a cooling cycle for the conditioned space, the improvement comprising:

said cryogen driven air mover means being disposed in the cryogen flow path downstream from the heat exchanger means, such that cryogen used to drive the cryogen driven air mover means has completed its usage in providing the cooling cycle for the conditioned space, and including means for controlling the flow of cryogen through the cryogen flow path to control the temperature of the conditioned space.

20. The refrigeration system of claim 19 wherein the supply of cryogen includes cryogen in a liquid state, and the cryogen flow path directs liquid cryogen from the supply of cryogen into the cryogen flow path, with the heat exchanger means vaporizing the liquid cryogen to provide vaporized cryogen for the cryogen driven air mover means.

21. The refrigeration system of claim 19 wherein the supply of cryogen includes cryogen in a vapor state, and the cryogen flow path directs cryogen in the vapor state from the supply of cryogen into the cryogen flow path.

22. The refrigeration system of claim 19 including means for selectively altering the cryogen flow path to by-pass the heat exchanger means and directs cryogen directly to the cryogen driven air mover means without going through the heat exchanger means.

23. The refrigeration system of claim 22 including heating means disposed in the cryogen flow path, upstream from the cryogen driven air mover means, said heating means heating cryogen the cryogen flow path to provide energy for operating the cryogen driven air mover means.

24. The refrigeration system of claim 19 including heating means disposed in the cryogen flow path downstream from the heat exchanger means and upstream from the air mover means, said heating means heating cryogen in the cryogen flow path to provide energy for operating the cryogen driven air mover means.

25. The refrigeration system of claim 19 including pressure regulator means for regulating the vapor pressure of vaporized liquid cryogen in the cryogen flow path to a point above the triple point of the cryogen, to prevent the formation of solid cryogen in the cryogen flow path.

26. The refrigeration system of claim 25 wherein the supply of cryogen is at a predetermined pressure above the triple point of the cryogen, with the pressure regulator means including means connected to a predetermined location of the cryogen flow path to introduce the supply pressure of the cryogen at the predetermined location of the cryogen flow path.

27. The refrigeration system of claim 19 including a second cryogen flow path disposed to connect the supply of cryogen directly to the cryogen driven air mover means by-passing the heat exchanger means, and means for directing cryogen from the source of cryogen through both cryogen flow paths simultaneously.

28. The refrigeration system of claim 27 wherein the supply of cryogen includes liquid cryogen, with both cryogen flow paths being connected to receive liquid cryogen from the supply of cryogen.

29. The refrigeration system of claim 27 including means combining the two cryogen flow paths upstream from the cryogen driven air mover means, and heating means disposed in the combined cryogen flow path, upstream from the cryogen driven air mover means, for heating cryogen flowing through the combined cryogen flow path.

30. The refrigeration system of claim 27 wherein the supply of cryogen includes liquid cryogen, and the two cryogen flow paths receive liquid cryogen from the supply of cryogen, and including ambient loop means disposed in the second cryogen flow path, said ambient loop means being exposed to ambient temperature, to provide heat for vaporizing the liquid cryogen in the second cryogen flow path.

31. The refrigeration system of claim 19 including means for selectively altering the cryogen flow path to by-pass the heat exchanger means, to direct cryogen directly to the cryogen driven air mover means without going through the heat exchanger means, heater means disposed in the cryogen flow path, upstream from the air mover means, for adding heat to the cryogen in the cryogen flow path, and an additional heat exchanger disposed in the cryogen flow path, with the cryogen driven air mover means moving air from the conditioned space in heat exchange relation with the additional heat exchanger, whereby the heated cryogen in the cryogen flow path flows through the cryogen driven air mover means and the additional heat exchanger to provide a heating cycle for the conditioned space.

32. The refrigeration system of claim 31 including means for selectively altering the cryogen flow path to provide a parallel cryogen flow path around the cryogen driven air mover means, such that heated cryogen flows to the additional heat exchanger through both the cryogen driven air mover means and said parallel cryogen flow path.

33. The refrigeration system of claim 19 including means for selectively altering the cryogen flow path to by-pass the heat exchanger means, to direct cryogen directly to the cryogen driven air mover means without going through the heat exchanger means, heating means disposed to heat cryogen in the cryogen flow path upstream from the air mover means, an additional heat exchanger in the cryogen flow path, downstream from the cryogen driven air mover means, for use in a defrost cycle, with the additional heat exchanger being disposed in heat exchange relation with the heat exchanger means, means for selectively altering the cryogen flow path to provide a by-pass cryogen flow path around the cryogen driven air mover means, such that cryogen heated by the heating means flows to the additional heat exchanger only via the by-pass cryogen flow path.

34. The refrigeration system of claim 19 wherein the heat exchanger means includes first and second serially connected heat exchangers in the cryogen flow path, and including means disposed in the cryogen flow path between the first and second heat exchangers for expanding cryogen isenthalpically.

35. The refrigeration system of claim 19 including heating means disposed in the cryogen flow path upstream from the heat exchanger means for heating cryogen in the cryogen flow path to provide a heating cycle for the conditioned space.

36. The refrigeration system of claim 19 including first heating means disposed in the cryogen flow path upstream from the heat exchanger means, for heating cryogen in the cryogen flow path to provide a heating cycle for the conditioned space, and second heating means disposed in the cryogen flow path downstream from the heat exchanger means and upstream from the cryogen driven air mover means, for heating cryogen in the cryogen flow path to provide energy for operating the cryogen driven air mover means.

37. The refrigeration system of claim 19 including heating means disposed in the cryogen flow path upstream from the heat exchanger means, and vent means for disposed in the cryogen flow path downstream from the heat exchanger means and upstream from the cryogen driven air mover means, said heating means heating the cryogen in the cryogen flow path, and said vent means exhausting heated cryogen from the cryogen flow path, to provide a defrost cycle for the heat exchanger means.

* * * * *